US007334703B2

(12) United States Patent
Schiestl

(10) Patent No.: US 7,334,703 B2
(45) Date of Patent: Feb. 26, 2008

(54) METHOD OF PRODUCING A PRESSURE CONTAINER FILLED WITH A PROPELLANT

(75) Inventor: Ulrich Schiestl, Feldkirch (AT)

(73) Assignee: Hilti Aktiengsellschaft, Schaan (LI)

( * ) Notice: Subject to any disclaimer, the term of this patent is extended or adjusted under 35 U.S.C. 154(b) by 571 days.

(21) Appl. No.: 10/847,098

(22) Filed: May 17, 2004

(65) Prior Publication Data

US 2004/0226963 A1 Nov. 18, 2004

(30) Foreign Application Priority Data

May 15, 2003 (DE) ..... 103 21 765

(51) Int. Cl.
*B65D 35/28* (2006.01)

(52) U.S. Cl. ..... 222/95; 222/94; 222/386.5; 141/20; 141/27

(58) Field of Classification Search ..... 222/94, 222/95, 386.5; 141/2–4, 10, 18–21, 25, 27
See application file for complete search history.

(56) References Cited

U.S. PATENT DOCUMENTS 2,815,152 A 12/1957 Mills
RE24,918 E 1/1961 Mills
5,032,619 A * 7/1991 Frutin et al. ..... 521/55
5,069,590 A 12/1991 Stoffel
5,277,336 A * 1/1994 Youel ..... 222/105

FOREIGN PATENT DOCUMENTS

DE 3625561 A1 2/1988

* cited by examiner

*Primary Examiner*—J. Casimer Jacyna
(74) *Attorney, Agent, or Firm*—Abelman, Frayne & Schwab

(57) ABSTRACT

A pressure container filled with a propellant (22) includes an outer container (10), an inner bag (20) arrangeable in the outer container, and a cover (15) for closing the outer container (10) and provided with an inlet/outlet valve element (16), with the propellant (22) being formed in the propellant chamber (21) of the inner bag (20) by a mixture of an inert gas (23) in the propellant chamber (21) with a gaseous phase (18) of a filling material (12) in the filling material chamber (11) of the outer container (10); and the method of forming the pressure container includes inserting an inner bag (20) filled with an inert gas (23) into the outer container (10), closing the outer container (10) with a cover (15), and filling the filling material chamber (11) of the outer container (10) with a filling material (12) having a gaseous phase (18) that migrates from the filling material chamber (11) into the propellant chamber (21) of the inner bag (20), and forms therein, together with the inert gas (23), the propellant (22).

4 Claims, 4 Drawing Sheets

METHOD OF PRODUCING A PRESSURE CONTAINER FILLED WITH A PROPELLANT

BACKGROUND OF THE INVENTION

1. Field of the Invention

The present invention relates to a method of producing a pressure container filled with a propellant and including forming an outer container having a filling material chamber for receiving a filling material, forming an inner bag having a propellant chamber for storing the propellant, inserting the inner bag into the outer container, and closing the outer container, and closing the outer container with a cover provided with an inlet/outer valve, and a pressure container produced by the above-discussed method.

2. Description of the Prior Art

Pressure containers of the type discussed above are used, e.g., in gas-operated setting tool, with fuel being stored in the containers.

A liquified gas, which is stored in such pressure containers is used, e.g., for driving combustion-engined bolt setting tools. In the bolt setting tool, the pressure containers or pressure capsules are arranged with a possibility of their replacement and are provided, e.g., with a metering head that is secured on a pressure capsule, e.g., with snap connection means. In an operational condition of the bolt setting tool, the system pressure container/capsule and the metering head are located in a receptacle formed in the setting tool. In many applications, the liquified gas needs to be fed in its liquified phase in each possible orientation of the pressure container or capsule to insure a correct metering of the liquified gas/fuel.

Generally known are one-chamber and two-chamber pressure containers. Thus, German laid-open patent application DE-OS 362 66 b1 discloses a one-chamber pressure container with propellant and a filling material being located in the chamber of the container and with the propellant being partially dissolved in the filling material.

With one-chamber pressure containers, a problem consists in that discharging of the liquified gas in its liquid phase at each orientation of the pressure container is not possible because the gaseous propellant phase and the dischargeable liquid filling material are always oriented in the chamber in accordance with the gravity force. The discharge of the liquid phase of the liquified gas is possible only with a transverse pressure container with an upwardly extending valve (with a riser on the discharge valve) or in a position with a downwardly oriented valve (a valve without a riser).

With a two-chamber pressure container, discharge of the liquid filling material is possible at each orientation of a pressure container.

A two-chamber pressure container is disclosed in U.S. Pat. No. 5,069,590. In this container, an inner, thin-wall metallic container, in particular, an aluminum container, is arranged in an outer, thick-wall container, e.g., likewise formed of aluminum. At the opening of the pressure container, the two containers are folded or rolled over one another. The opening is closed with a cover provided with a valve. The filling material fills the inner container, and the propellant is located in the outer container.

The drawback of the pressure container of U.S. Pat. No. 5,069,590 consists in that the inner container with a relatively large amount of the filling material is subjected to strong mechanical stresses when acceleration forces act on the container. Further, some of the propellant can leak from the outer container through the rolled crimp. The ratio of the propellant to the filling material in fuel pressure containers for setting tools amounts approximately to 5/40 (e.g., 5 g/40 g). In particular, with a long storage and with a loss of the propellant 3-4 g per year, the pressure container can become unusable. Furthermore, two-chambers pressure containers are more expensive in production than one-chamber pressure containers.

Therefore, its is advantageous when the propellant is located in the inner container because in this case, the loss of the filling material or fuel influences the operating ability of the pressure container much less than the loss of the propellant.

U.S. Pat. No. 2,815,152, from which the present invention proceeds, discloses a method of producing a pressure container and a container produced by the method where the propellant is located in an inner container, which is formed as a freely movable, flexible bag, and the filling material is located in the outer container. The inner container is closed from all sides and contains the propellant in both liquid and gaseous phases.

According to the method disclosed in U.S. Pat. No. 2,815,152, after the inner bag is formed, the propellant is introduced into the bag under pressure sufficient to retain the propellant in the liquid phase. Then, the bag is closed. Thereafter, the bag and a predetermined amount of the filling material are brought together into the outer container which is closed under temperature and pressure conditions sufficient to retain the filling material in its liquid phase.

The method of U.S. Pat. No. 2,815,152 is rather expensive because during the entire manufacturing stage, a high pressure needs to be applied to the components of the pressure container to prevent evaporation of the propellant.

Accordingly, an object of the present invention is a method of producing a pressure container filled with a propellant of a type discussed above, but without the drawbacks of the prior art.

SUMMARY OF THE INVENTION

This and other objects of the present invention, which will become apparent hereinafter, are achieved by providing a method of producing a pressure container filled with propellant and including forming an outer form-stable container having a filling material chamber for receiving a filling material, forming an inner bag of a permeable plastic material and having a propellant chamber for storing the propellant, filing the propellant chamber at least partially, with an inert gas and closing the inner bag, inserting the inner bag filled with the inert gas into the outer container, thereafter, closing the outer container with a cover provided with an inlet/outlet valve, and filling the filling material chamber of the outer container with a filling material having a gaseous phase. The gaseous phase migrates from the filling material chamber into the propellant chamber of the inner bag forming therein, together with the inert gas, the propellant.

The inventive method substantially reduces manufacturing costs of producing of pressure containers because the insertion of the inner container (inner bag) in the outer container is effected under normal environmental conditions (pressure, temperature). Because the pressure container is closed, normal environmental condition can be retained even when the filling material is introduced into the outer container under pressure through a union. The inventive method is particularly suitable for manufacturing of fuel pressure containers for combustion-engined setting tool.

The advantage of the produced pressure container consists, among others, in that it can be used even after a long period of storage (more than 1 year) because the propellant in the propellant chamber contains, as an essential component, the gaseous phase of the filling material.

According to an advantageous embodiment of the present invention, the inner bag is formed of a film or foil, e.g., of a plastic film made from polyethylene (PE).

As an inert gas, e.g., air can be used, which further reduces the production costs.

Advantageously, the pressure container is stored, after it has been filled with the filling material, for some minimal time to insure a complete migration/diffusion of the gaseous phase of the filling material into the propellant chamber. The migration time depends on and can vary with material and thickness of a bag wall and type of the filling material or the liquified gas filling the filling material chamber.

The foregoing measure insures that at the first use of the pressure container, the gaseous phase of the filling material is located in its entirety in inner bag, so that the pressure container is ready for use.

For use of the pressure container in a combustion-engined setting tool, a combustible liquified gas can be used as a filling material. The setting tools with inventive pressure containers can be used independently from their positions, without mismatched use because of incorrect metering.

With the inventive pressure container, the propellant, which fills the inner bag, contains inert gas and a gaseous phase of the filling material, e.g., a liquified fuel gas or fuel gas mixture. Because the inner bag is permeable, the propellant can be introduced from a filling material reservoir into the filling material chamber if loss of the propellant takes place. The inventive pressure container can be used until the filing material is completely exhausted.

The novel features of the present invention, which are considered as characteristic for the invention, are set forth in the appended claims. The invention itself, however both as to its construction and its mode of operation, together with additional advantages and objects thereof, will be best understood from the following detailed description of preferred embodiment, when read with reference to the accompanying drawings.

DETAILED DESCRIPTION OF THE PREFERRED EMBODIMENTS

A pressure container according to the present invention, which is shown in FIGS. 1-4, is generally formed of an outer container 10 and an inner bag 20. The outer container 10 is formed of a relatively thick metallic material, e.g., aluminum, whereas the inner bag 20 has a bag wall 24 formed of a relatively thin, permeable plastic film formed, e.g., of polyethylene.

Figure 1:
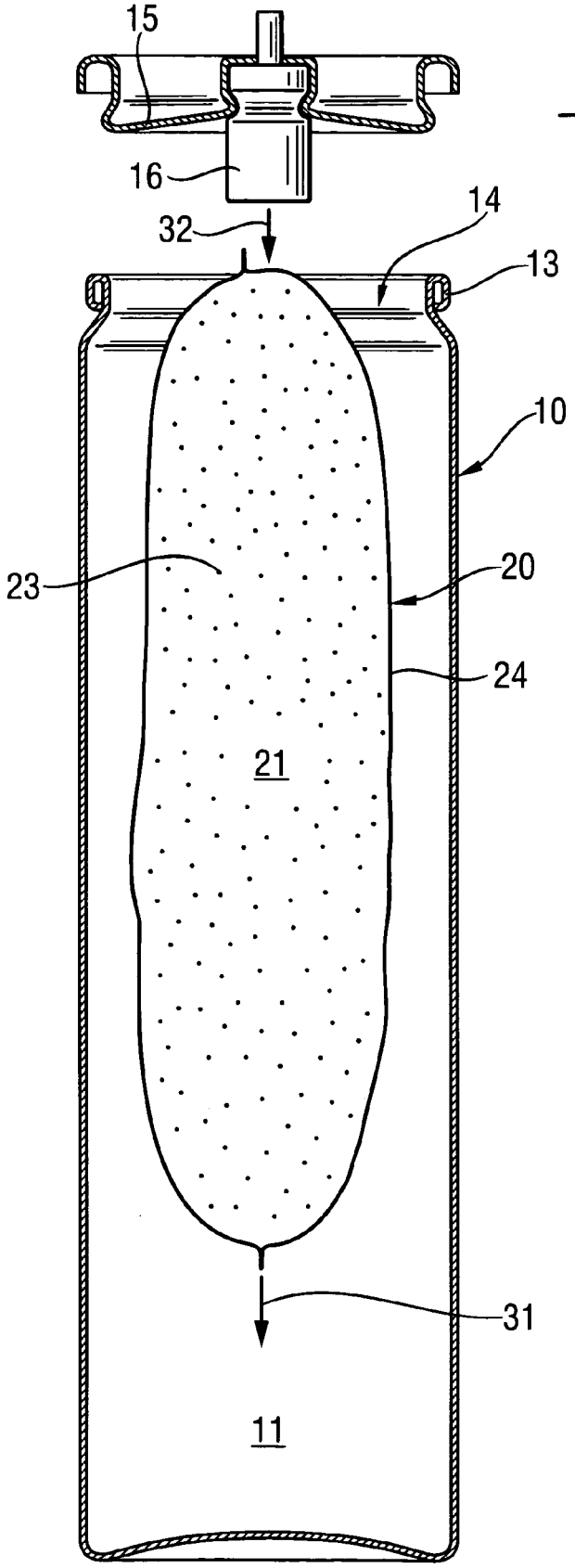
FIG. 1 an exploded, longitudinal cross-sectional view of a pressure container according to the present invention in a non-filled condition.
Figure 2:
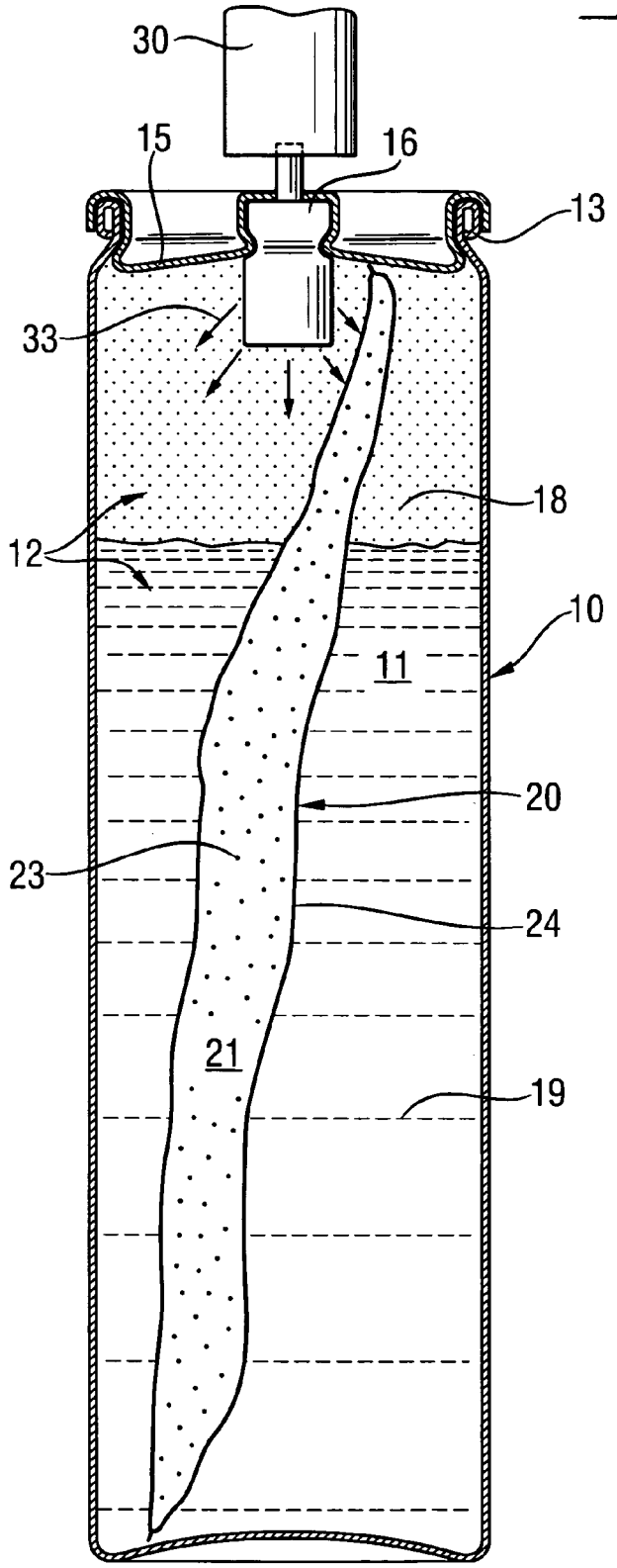
FIG. 2 a longitudinal cross-sectional view of the pressure container shown in FIG. 1 during a filling process.
Figure 3:
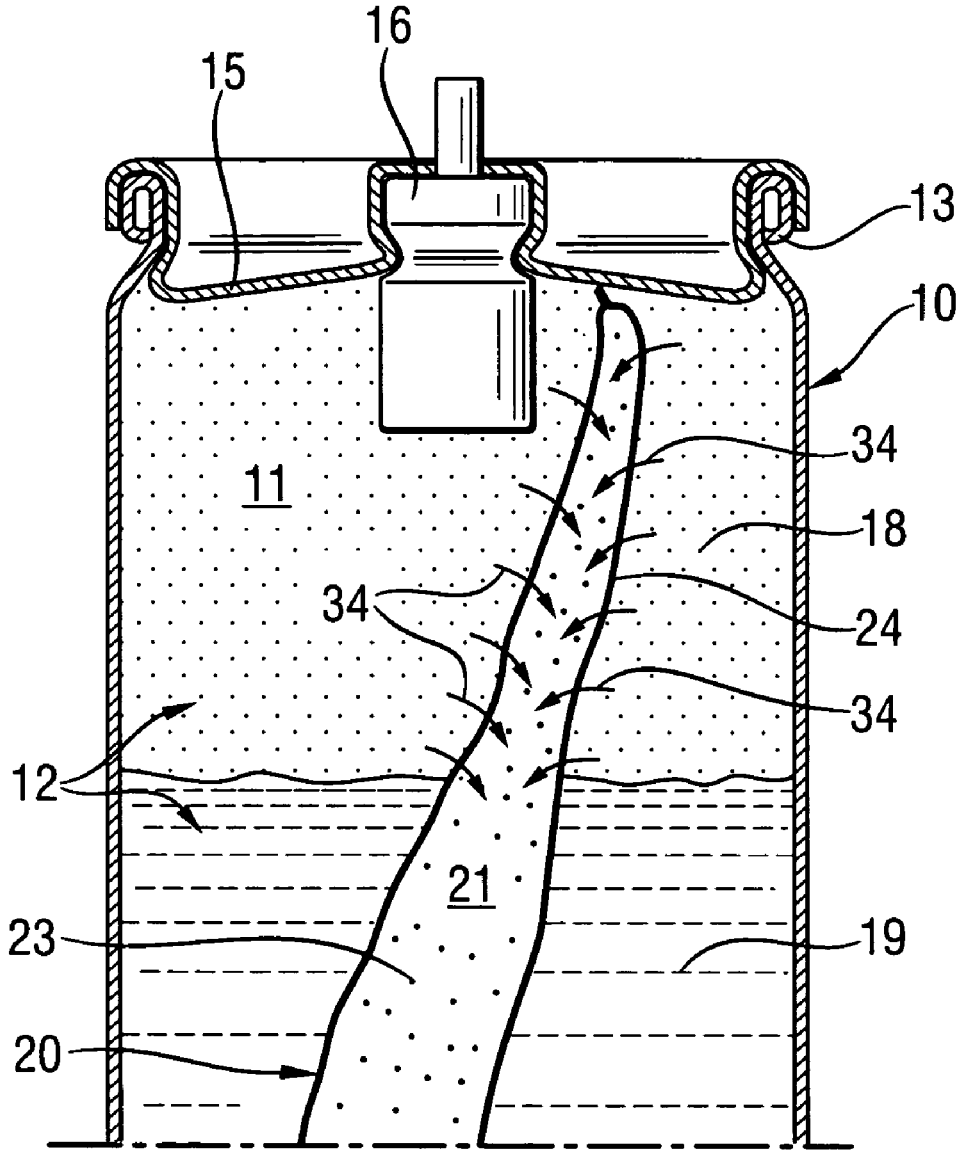
FIG. 3 a longitudinal, cross-sectional, partial view of the pressure container shown in FIG. 1 at an increased, in comparison with FIG. 1, scale in a completely filled condition.

FIGS. 1-3 show the steps of forming and filling a pressure container according to the present invention. In the first step, the inner bag 20 is filled, at least partially, with an inert gas 23, e.g., air, and is then closed. With regard to the present invention, under an inert gas, a gas that cannot penetrate through the permeable bag wall 24, is understood. After being filled with the inert gas, the inner bag 20 is inserted, in the direction shown with arrow 31, in the outer container 10. The opening 14 of the outer container is then closed with a cover 15 which is provided with a valve element 16. The cover 15 is displaced for closing the outer container 10 in the direction shown with arrow 32. After the cover 15 is placed on the outer container 10, they are crimped together, forming a rolled crimp 13.

In the following step shown in FIG. 2, the pressure container is filled with a filling material 12 through a filling union 30, as shown with arrows 33. The filling is effected through the valve element 16 that also serves for feeding the filling material from the pressure container in the inserted condition of the pressure container. During and after the filling process, the filling material 12, e.g., a combustible liquified gas, is present in both a gaseous phase 18 and a liquid phase 19 in the filling material chamber 11 of the outer container 10. The inner bag 20 and the inert gas 23 in the chamber 21 of the inner bag 20 become compressed by the pressure applied by the filling material 12.

Figure 4:
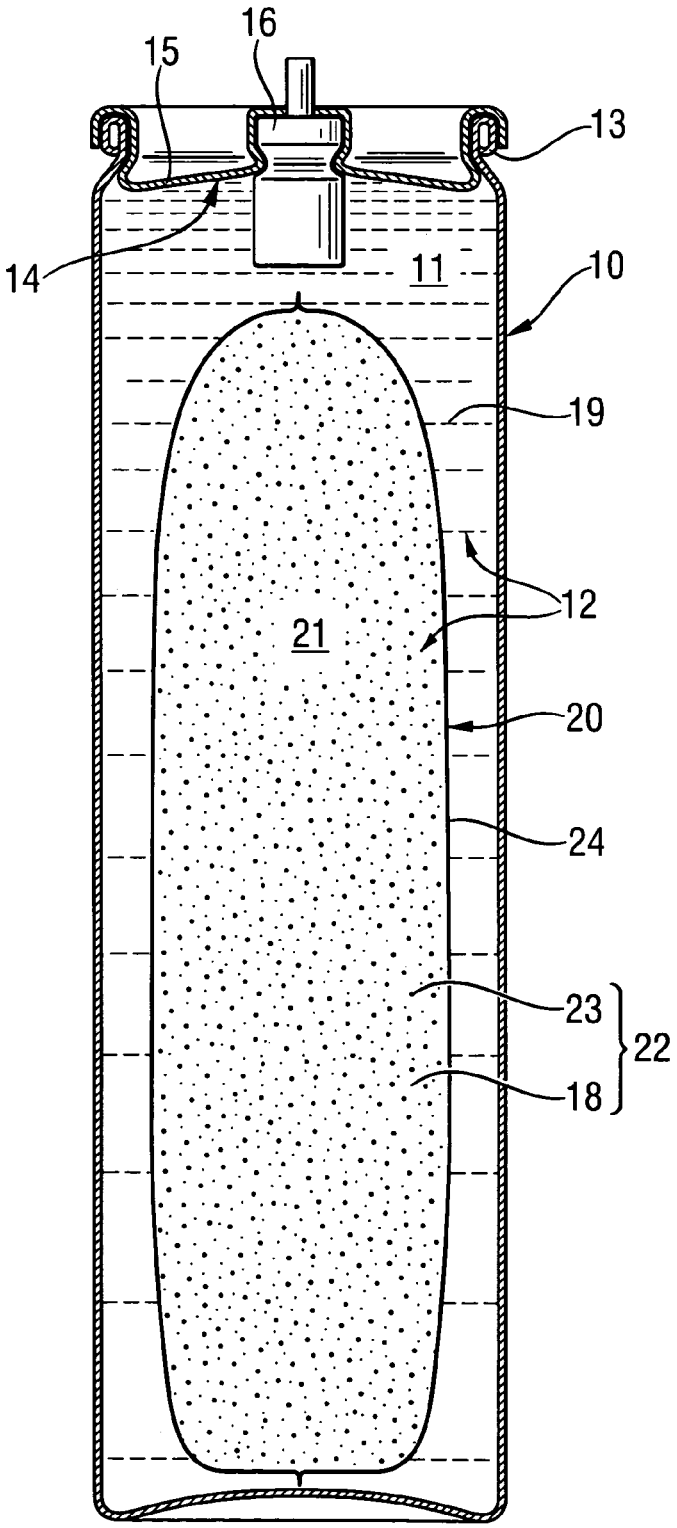
FIG. 4 a longitudinal cross-sectional view of a pressure container according to the present invention in a ready-to-be mounted condition.

After the filling process has been completed, the gaseous phase 18 of the filling material 12 migrates, as shown with arrows 34, from the filling material chamber 11 through the bag wall 24 into the chamber 21 which forms the propellant chamber. This migration process ends and the pressure container is ready for being used when no gaseous phase 18 of the filling material 12 remains in the filling material chamber 11, as shown in FIG. 4. The gaseous phase 18 of the filling material 12 and the inert gas 23 form together a propellant 22 that fills the chamber 21 of the inner bag 20.

Through the valve element 16 in the cover 15, the filling material 12 can be discharged only in a position of the pressure container in which the filling material is under pressure of the propellant 22.

Though the present invention was shown and described with references to the preferred embodiment, such is merely illustrative of the present invention and is not to be construed as a limitation thereof and various modifications of the present invention will be apparent to those skilled in the art. It is therefore not intended that the present invention be limited to the disclosed embodiment or details thereof, and the present invention be limited to the disclosed embodiment or details thereof, and the present invention includes all variations and/or alternative embodiments within the spirit and scope of the present invention as defined by the appended claims.

What is claimed is:

1. A pressure container filled with a propellant, comprising:

an outer container (10) having a filling material chamber (11) for receiving a filling material (12) having a gaseous phase (18);

an inner bag (20), including a bag wall (24), with the inner bag (20) formed of a material which is permeable to the filling material, and with the inner bag (20) being arrangeable in the outer container (10) and having a propellant chamber (21) for storing the propellant (22); and a cover (15) for closing the outer container (10) and provided with an inlet/outlet valve element (16);

wherein the propellant (22) is formed in the propellant chamber (21) of the inner bag (20) by a mixture of an inert gas (23) in the propellant chamber (21) with the gaseous phase (18) of the filling material (12) in the filling material chamber (11) of the outer container (10); and wherein the inert gas (23) cannot penetrate through the bag wall (24) of the inner bag (20).

2. A pressure container according to claim 1, wherein the inner bag is formed of a plastic film.

3. A pressure container according to claim 1, wherein the inert gas (23) is air.

4. A pressure container according to claim 1, wherein the filling material (12) is a combustible liquified gas.

* * * * *